US009117586B2

(12) United States Patent
McConnell et al.

(10) Patent No.: US 9,117,586 B2
(45) Date of Patent: Aug. 25, 2015

(54) TRIMMABLE TRANSFORMER ARRANGEMENT

(75) Inventors: Roderick McConnell, Munich (DE); Bernhard Strzalkowski, Munich (DE)

(73) Assignee: Infineon Technologies Austria AG, Villach (AT)

( * ) Notice: Subject to any disclaimer, the term of this patent is extended or adjusted under 35 U.S.C. 154(b) by 1097 days.

(21) Appl. No.: 12/400,141

(22) Filed: Mar. 9, 2009

(65) Prior Publication Data

US 2010/0226064 A1 Sep. 9, 2010

(51) Int. Cl.

| | |
|---|---|
| ***H01F 5/04*** | (2006.01) |
| ***H01F 27/42*** | (2006.01) |
| *H01F 30/08* | (2006.01) |

(52) U.S. Cl.

CPC ..... *H01F 27/42* (2013.01); *H01F 30/08* (2013.01)

(58) Field of Classification Search

CPC ..... H01F 38/12; H01F 27/40; H01F 38/30; H01F 17/04; H01F 27/2847; H01F 27/42; H01F 30/08

USPC ..... 361/270

See application file for complete search history.

(56) References Cited

U.S. PATENT DOCUMENTS

| | | | | |
|---|---|---|---|---|
| 5,953,642 | A * | 9/1999 | Feldtkeller et al. | 455/195.1 |
| 7,768,371 | B2 * | 8/2010 | Hui et al. | 336/200 |
| 8,218,810 | B1 * | 7/2012 | Griess et al. | 382/100 |
| 8,223,508 | B2 * | 7/2012 | Baarman et al. | 363/17 |
| 2004/0130916 | A1 * | 7/2004 | Baarman | 363/21.02 |
| 2005/0156699 | A1 | 7/2005 | Hui et al. | |
| 2008/0231211 | A1 | 9/2008 | Baarman et al. | |
| 2009/0033440 | A1 * | 2/2009 | Masuda et al. | 333/215 |

FOREIGN PATENT DOCUMENTS

| | | |
|---|---|---|
| DE | 4438287 C1 | 5/1996 |
| EP | 0935263 B1 | 5/2004 |

OTHER PUBLICATIONS

Qingxin Yang, Jiangui Li, Haiyan Chen and Junhua Wang; "Design and Analysis of New Detachable Coreless Transformer Used for Contact-less Electrical Energy Transmission System"; IEEE Vehicle Power and Propulsion Confrence; Sep. 3-5, 2008; pp. 1-4.*

Uno, T., et al., A New Digital TCXO Circuit Using a Capacitor-Switch Array, Musashino Electrical Communication Laboratory, Nippon Telegraph and Telephone Public Corporation,1983, pp. 434-441, IEEE.

* cited by examiner

*Primary Examiner* — Jared Fureman
*Assistant Examiner* — Nicholas Ieva
(74) *Attorney, Agent, or Firm* — Slater & Matsil, L.L.P.

(57) ABSTRACT

A circuit arrangement includes a coreless transformer. A trimming device is connected to the transformer and includes a variable capacitance and/or inductance.

15 Claims, 9 Drawing Sheets

TRIMMABLE TRANSFORMER ARRANGEMENT

BACKGROUND

Coreless transformers are transformers that do not have a transformer core. Such coreless transformers can be integrated in or on a semiconductor chip or on a printed circuit board (PCB). These transformers can, therefore, be realized in a space-saving manner. Such transformers can be used in circuit applications in which data or electrical energy is to be transmitted across a potential barrier between two circuits that have different reference potentials. Such a circuit is, for example, a gate drive circuit of a high-side power semiconductor switch, like a MOSFET or an IGBT.

Coreless transformers have a maximum impedance frequency (MIF), which is the frequency for which the transformer has its highest input impedance, and have a maximum efficiency frequency (MEF), which is the frequency for which the transformer has its lowest transmission losses. In particular, when power is to be transmitted using a coreless transformer it is desired to operate the transformer at its, or at least close to its MEF. For a given load scenario MEF and MIF are different from each other, with a difference between MEF and MIF becoming larger with increasing load current.

Transmission properties of a coreless transformer and, therefore, MEF and MIF depend on a number of electrical parameters which, inter alia, include: inductivities of the transformer's primary and secondary windings; ohmic resistances of the transformer's primary and secondary windings; input and output capacitances of the transformer; and an inductive coupling between the transformer's primary and secondary windings. These parameters, due to process variations, may vary even for those transformers that are produced using identical process steps.

SUMMARY OF THE INVENTION

One aspect of the present disclosure relates to a circuit arrangement that includes: a transformer having a first winding and a second winding. A trimming device is connected to one of the first and second windings and includes at least one of a variable capacitive component and a variable inductive component.

A further aspect relates to a method for signal or power transmission through a circuit arrangement that includes: input terminals and a coreless transformer having a first winding and a second winding. A trimming device is connected to one of the first and second windings and includes at least one of a variable capacitive component and/or a variable inductive component. The circuit arrangement has a maximum efficiency frequency (MEF) and a maximum impedance frequency (MIF) that is dependent on one of capacitance or inductance. In the method, an input signal that has an input frequency is applied to the input terminals. One of the MEF and MIF of the circuit arrangement is adjusted to be equal to the input frequency or differ from the input frequency for less than a given frequency difference by adjusting at least one of the adjustable capacity and the variable inductivity.

BRIEF DESCRIPTION OF THE DRAWINGS

Examples will now be explained with reference to the drawings. The drawings serve to explain the basic concept. Therefore, only those aspects required for explaining this basic concept are shown in the figures. In the figures, unless stated otherwise, same reference signs denote the same features with the same meaning.

DETAILED DESCRIPTION OF ILLUSTRATIVE EMBODIMENTS

Figure 1:
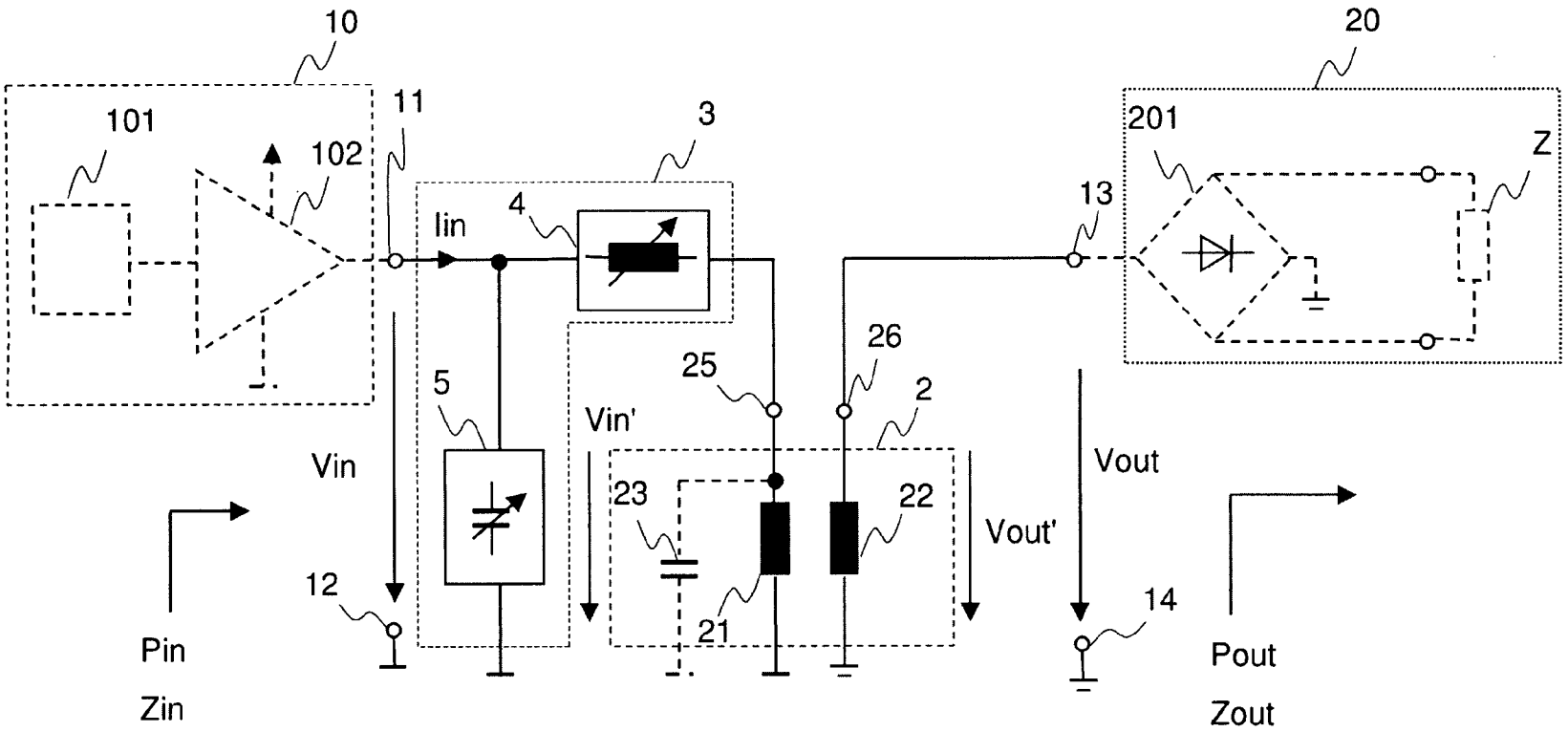
FIG. 1 illustrates a circuit diagram of a transformer arrangement that has a coreless transformer and a trimming circuit connected to a primary winding of the coreless transformer.

FIG. 1 illustrates a first example of a transformer arrangement by way of a circuit diagram. The transformer arrangement includes a coreless transformer 2 having a primary winding 21 and a secondary winding 22 that are inductively coupled to each other. Primary winding 21 has a parasitic capacitance 23 that lies parallel to primary winding 21. Such parasitic capacitance 23 is shown in dashed lines in FIG. 1 and has reference number 23.

Coreless transformer 2 may be any kind of coreless transformer, including a coreless transformer having its primary and secondary windings disposed on a printed circuit board (PCB), or a coreless transformer having its primary and secondary windings integrated in or disposed on a semiconductor chip. The transformer arrangement further comprises input terminals 11, 12 for applying an input voltage Vin, and output terminals 13, 14 for providing an output voltage Vout. One of the input terminals, e.g., second input terminal 12 in the example according to FIG. 1, is connected to a terminal for a first reference potential, which will be referred to as primary-side reference potential in the following. One of the output terminals, e.g., the second output terminal 14 in the example according to FIG. 1, is connected to a terminal for a second reference potential, which will be referred to as secondary-side reference potential in the following.

The transformer arrangement further comprises a trimming circuit 3 that is connected between input terminals 11, 12 and primary winding 21. Trimming circuit 3 includes at least one of: an adjustable inductance unit 4 that has an adjustable inductivity and that is connected in series to primary winding 21; and an adjustable capacitance unit 5 that has an adjustable capacity and that is connected in parallel to primary winding 21. Adjustable capacitance unit 5 may be connected (as shown) in parallel to a series circuit comprising adjustable inductance unit 4 and primary winding 21. Alternatively adjustable capacitance unit 5 may also be connected parallel to primary winding 21, even in those cases in which the transformer arrangement includes adjustable inductance unit 4. It should be noted that the transformer arrangement may include both, adjustable inductance unit 4 and adjustable capacitance unit 5, or only one of these adjustable units 4, 5.

Figure 2:
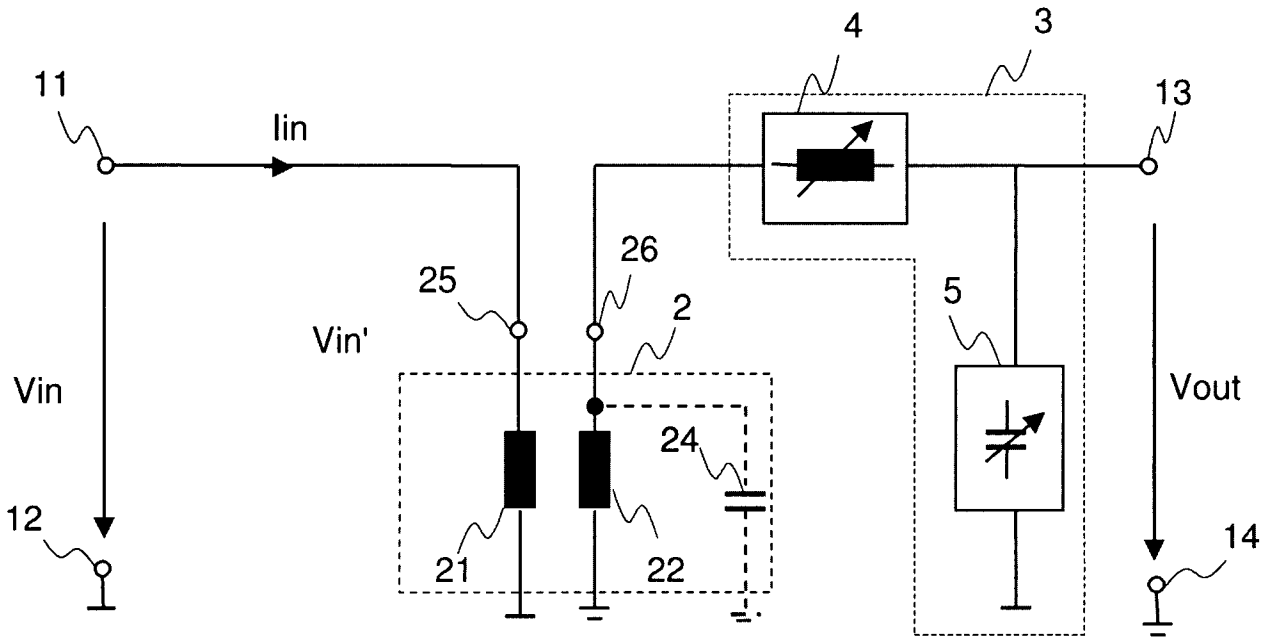
FIG. 2 illustrates a circuit diagram of a transformer arrangement that has a coreless transformer and a trimming circuit connected to a secondary winding of the coreless transformer.

Referring to FIG. 2 trimming circuit 3 may also be connected between secondary winding 22 and output terminals 13, 14. Reference number 24 in FIG. 2 denotes a parasitic capacitance of secondary winding 22. Adjustable inductance unit 4 is in this case connected in series to secondary winding 22, and adjustable capacitance unit 5 is (as shown) connected parallel to the series circuit with secondary winding 22 and adjustable inductance unit 4. Alternatively adjustable capacitance unit 5 may be connected only in parallel to secondary winding 22, even in those cases in which the transformer arrangement comprises an adjustable inductance unit 4.

Referring to FIG. 1 the transformer arrangement is adapted to have a driver circuit 10 (shown in dashed lines) connected to its input terminals 11, 12, and to have a load circuit 20 connected to its output terminals 13, 14. During operation of the transformer arrangement driver circuit 10 generates an input voltage Vin at the input terminals 11, 12 of the transformer arrangement from which the transformer arrangement generates an output voltage Vout at its output terminals 13, 14. The input voltage Vin is an oscillating or alternating voltage. Accordingly, the output voltage Vout is an oscillating or alternating voltage.

Figure 3:
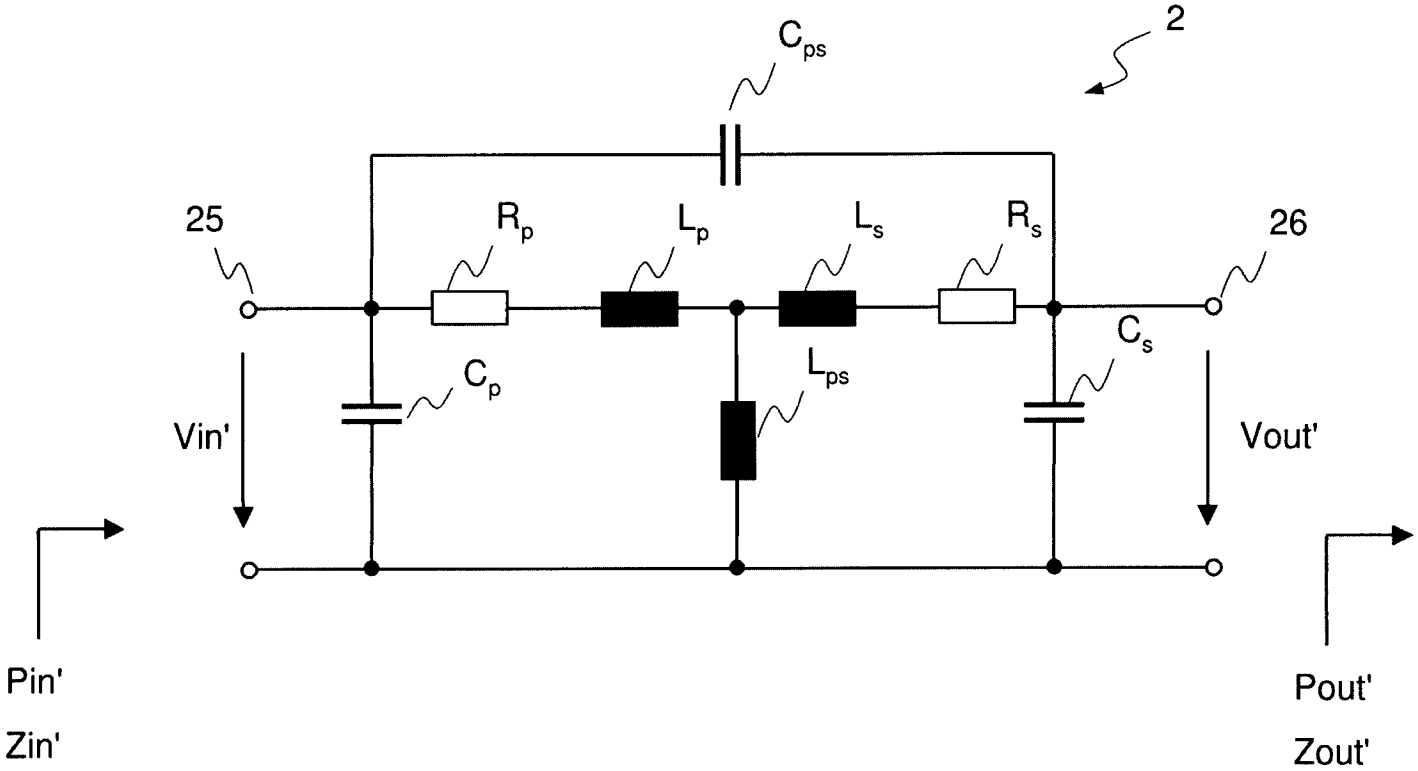
FIG. 3 illustrates an equivalent circuit diagram of a coreless transformer.

Referring to FIG. 3 coreless transformer 2 may be described by way of an equivalent circuit diagram. In this equivalent circuit diagram Vin' is a voltage applied to the primary winding 21, and Vout' is a voltage resulting from input voltage Vin' across secondary winding 22. These voltages are also shown in FIG. 1. FIG. 3 shows the equivalent circuit diagram for the specific case in which a primary reference potential corresponds to a secondary reference potential. An equivalent circuit diagram for a more general case in which these reference potentials are different, corresponds to the circuit diagram of FIG. 3 and additionally includes an ideal transformer (not shown) connected to either the input terminals or the output terminals of the diagram in FIG. 3. Reference numbers 25 and 26 in FIG. 3 denote input and output terminals of the coreless transformers. These terminals are also shown in FIG. 1.

Referring to the equivalent circuit diagram of FIG. 3 electrical characteristics of the coreless transformers 2 depend on the following: an input capacitance $C_p$ that is connected parallel to the input terminals of coreless transformers 2; an output capacitance $C_S$ that is connected between the output terminals of coreless transformer 2; a coupling capacitance $C_{ps}$ that is connected between one of the input terminals and one of the output terminals of coreless transformer 2; ohmic resistance $R_p$ of primary winding 21; a primary leakage inductance $L_p$; a secondary leakage inductance $L_s$; an ohmic resistance $R_s$ of secondary winding; and a primary mutual inductance $L_{ps}$. These electrical parameters define the electrical characteristics of coreless transformer 2. These electrical characteristics, for example, are: an input impedance Zin', with:

$$Zin' = \left|\frac{Vin'}{Iin'}\right|, \tag{1}$$

wherein Vin' is an input voltage and Iin' is an input current resulting from the input voltage Vin'; input power Pin' with:

$$Pin' = Vin' \cdot Iin' \tag{2},$$

output resistance Zout' with:

$$Zout' = \left|\frac{Vout'}{Iout'}\right|, \tag{3}$$

wherein Vout' is an output voltage and Iout' is an output current; or output power Pout' with:

$$Pout' = Vout' \cdot Iout' \tag{4}.$$

A further important electrical characteristic of coreless transformer 2 is its power efficiency η that is given by:

$$\eta = \frac{Pout'}{Pin'}. \tag{5}$$

Further electrical characteristics of coreless transformer 2 are its maximum impedance frequency (MIF) and its maximum efficiency frequency (MEF). The maximum impedance frequency is the frequency of input voltage Vin' for which input impedance Zin' of coreless transformer 2 reaches its maximum. The maximum efficiency frequency is the frequency of the input voltage Vin' of coreless transformer 2 for which power transfer efficiency l reaches its maximum. In this connection it should be mentioned that MIF and MEF depend on the load that is connected to the output terminals of coreless transformer 2.

The electrical characteristics of different coreless transformers that are produced using identical process steps may vary due to process variations. Trimming circuit 3 that, referring to FIGS. 1 and 2, is either connected to primary winding 21 or to secondary winding 22 serves to compensate for such variations in the electrical characteristics of the coreless transformer 2.

Referring to FIG. 1, input and output resistances Zin, Zout with:

$$Zin = \frac{Vin}{Iin}, \tag{6}$$

and $$Zout = \frac{Vout}{Iout}, \tag{7}$$

and input and output power Pin, Pout with:

$$Pin = Vin \cdot Iin \tag{8},$$

$$Pout = Vout \cdot Iout \tag{9},$$

may be defined for the transformer arrangement. Further, the transformer arrangement as a whole, like the coreless transformer 2, has a maximum impedance frequency (MIF) and a maximum efficiency frequency (MEF).

In one example trimming circuit 3 serves to compensate for variations in the electrical characteristics of coreless transformer 2 in order to set the MIF or the MEF of the transformer arrangement to a given frequency value or at least close to a given frequency value. This given frequency value is, for example, the frequency of the input voltage Vin provided by driver stage 10. Setting MEF or MIF "close to a given frequency" means that MEF or MIF differs less than a given frequency difference from the given frequency. This difference is, for example, less than about 10% or less than about 5% of the given frequency.

Trimming circuit 3 is adapted to adjust the electrical characteristic of the transformer arrangement having a coreless transformer 2. Transformer arrangements that have coreless transformers 2 with different electrical characteristics can, using the trimming circuit 3, be adjusted to have identical or almost identical electrical characteristics and can therefore be driven using identical driver stages 10. If trimming circuit 3 trims the transformer arrangement to have either its MIF or to have its MEF at the given frequency is dependent on a specific application of the transformer arrangement. In applications in which the transformer arrangement serves to transfer power, trimming circuit 3 may adjust the MEF to the given frequency; and in applications in which the transformer arrangement is used to transmit information as well as in applications in which the input impedance should be as high as possible, trimming circuit 3 adjusts the MIF of the transformer arrangement to the given frequency value.

Figure 4:
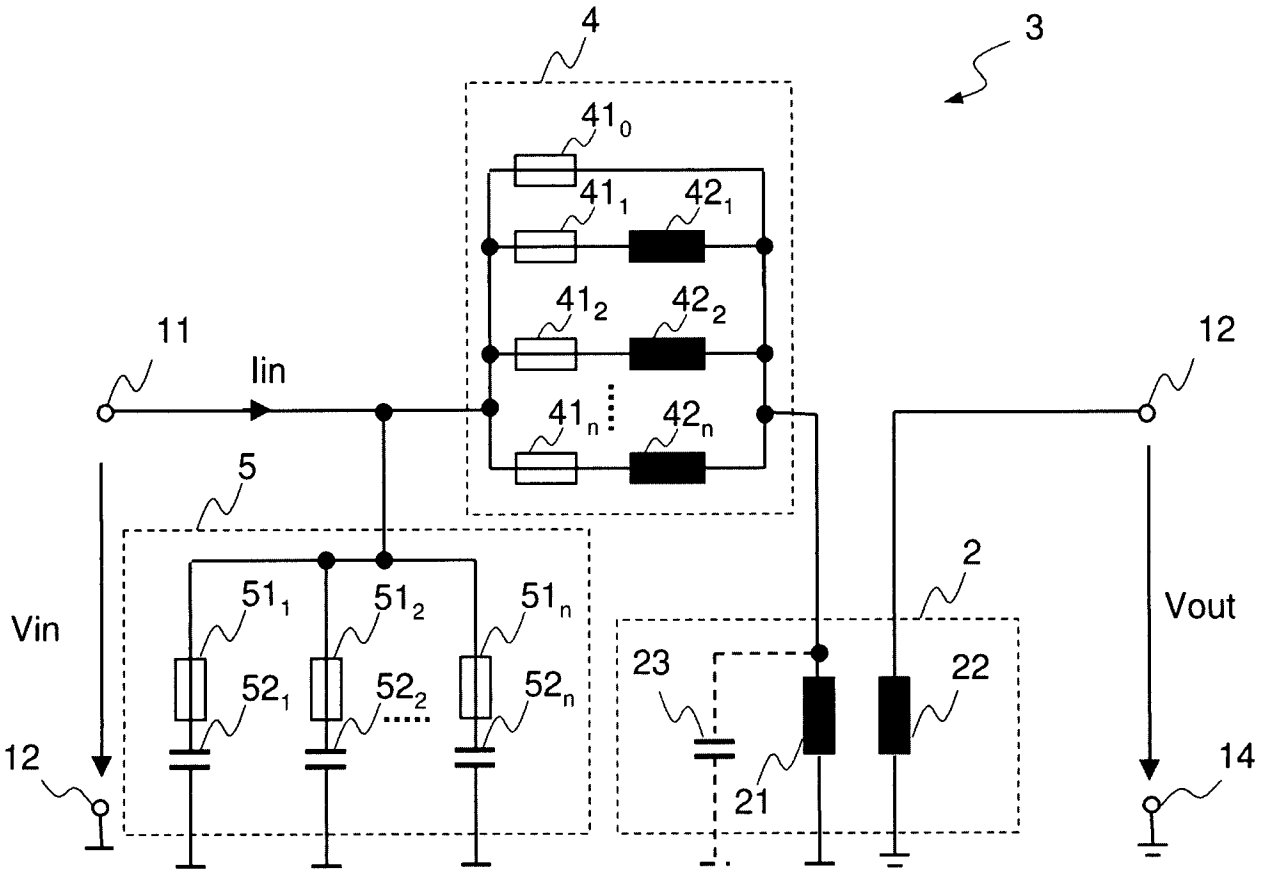
FIG. 4 illustrates a first example of the trimming circuit.

Examples of methods for trimming the MIF or MEF of a transformer arrangement to a given frequency value using trimming circuit 3 will now be explained with reference to further figures. In a first method the electrical characteristics of the transformer arrangement are set during manufacturing or at the end of manufacturing the transformer arrangement. FIG. 4 illustrates examples of adjustable inductance and adjustable capacitance circuits 4, 5 that are suitable for setting electrical characteristics of the transformer arrangement during manufacturing or at the end of manufacturing. The adjustable inductance circuit 4 according to this example includes a number of series circuits each of which comprising an inductance $\mathbf{42}_1$, $\mathbf{42}_2$, $\mathbf{42}_n$ and a fuse $\mathbf{41}_1$, $\mathbf{41}_2$, $\mathbf{41}_n$, A further fuse $\mathbf{41}_0$ directly connects input terminal 11 and primary winding 21. The adjustable inductance circuit 4 has its lowest inductance in case further fuse $\mathbf{41}_0$ is conducting. The fuses $\mathbf{41}_0$-$\mathbf{41}_n$ may be any kind of fuses, in particular, fuses that can be manufactured with processes that are used for producing semiconductor components. The overall inductance of adjustable inductance circuit 4 can be set by selectively melting the fuses during manufacturing or at the end of manufacturing of the transformer arrangement.

Adjustable capacitance circuit 5 has a number of series circuits each of which comprising a capacitance $\mathbf{52}_1$, $\mathbf{52}_2$, $\mathbf{52}_n$ that is connected in series to a fuse $\mathbf{51}_1$, $\mathbf{51}_2$, $\mathbf{51}_n$, the series circuits being connected in parallel to each other. The overall capacitance of adjustable capacitance circuit 5 is set by selectively melting the fuses $\mathbf{51}_1$, $\mathbf{51}_2$, $\mathbf{51}_n$ during manufacturing or at the end of manufacturing the transformer arrangement.

The overall inductance of adjustable inductance circuit 4 and/or the overall capacitance of adjustable capacitance circuit 5 influence the electrical characteristics of the transformer arrangement. To determine the inductance value and/or the capacitance value that have to be set for adjustable inductance circuit 4 and/or adjustable capacitance circuit 5 the electrical characteristics of coreless transformer 2 are measured at the end of the manufacturing process. For example, the MEF and the MIF of coreless transformer 2 is evaluated. Further, a difference between the measured MIF or MEF of coreless transformer 2 and a desired MEF or MIF of the transformer arrangement is determined and the inductance value of adjustable inductance 4 and/or the capacitance value of adjustable capacitance value 5 are selected so as to compensate for this difference, wherein MEF or MIF of the transformer arrangement corresponds to MEF or MIF of coreless transformer 2, if fuse $\mathbf{41}_0$ of inductance circuit 4 is conducting, and if all fuses $\mathbf{51}_1$-$\mathbf{51}_n$ of capacitance circuit 5 have been melted or blown.

MEF and MIF of coreless transformer 2 due to process variations may vary. In one example a maximum variation of this MEF or MIF is defined, where coreless transformers 2 having a MEF or MIF being outside this defined range will be discarded. For MEF values or MIF values that are within this given range settings for inductance circuit 4 and/or capacitance circuit 5 that are required to set MIF or MEF of the transformer arrangement to a given value can be obtained by simulations or tests. Using such simulations or tests a look-up table can be generated that to each MIF or MEF value, that is within the given range, assigns setting parameters for inductance circuit 4 and/or capacitance circuit 5. These setting parameters indicate the fuses of inductance circuit 4 and/or capacitance circuit 5 that have to be melted or blown in order to obtain the desired MEF or MIF of the transformer arrangement. In this connection it should be mentioned that either fuses that conduct in their activated state, or fuses that electrically isolate in their activated state may be used in inductance circuit 4 and/or capacitance circuit 5.

Figure 5:
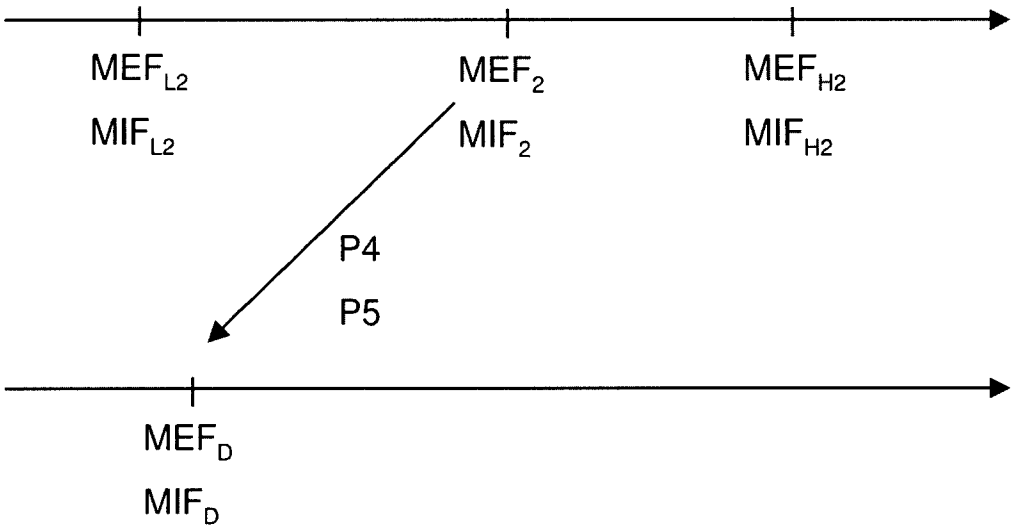
FIG. 5 illustrates a method for an MEF trimming procedure.

A method for setting MEF/MIF of the transformer arrangement to a desired value $MEF_D/MIF_D$ is illustrated in FIG. 5. $MEF_2$, $MIF_2$ denote measured MEF/MIF values of coreless transformer 2. P4, P5 are setting parameters of inductance circuit 4 and capacitance circuit 5 that considering the measured MEF/MIF values are used for setting MEF/MIF of the transformer arrangement to the desired value $MEF_D/MIF_D$. $MEF_{2L}/MIF_{2L}$ and $MEF_{2H}/MIF_{2H}$ denote lower and upper borders of the MEF/MIF range of coreless transformer 2. For a number of MEF/MIF values of this range setting parameters P4, P5 have been obtained by simulations or tests.

Figure 6:
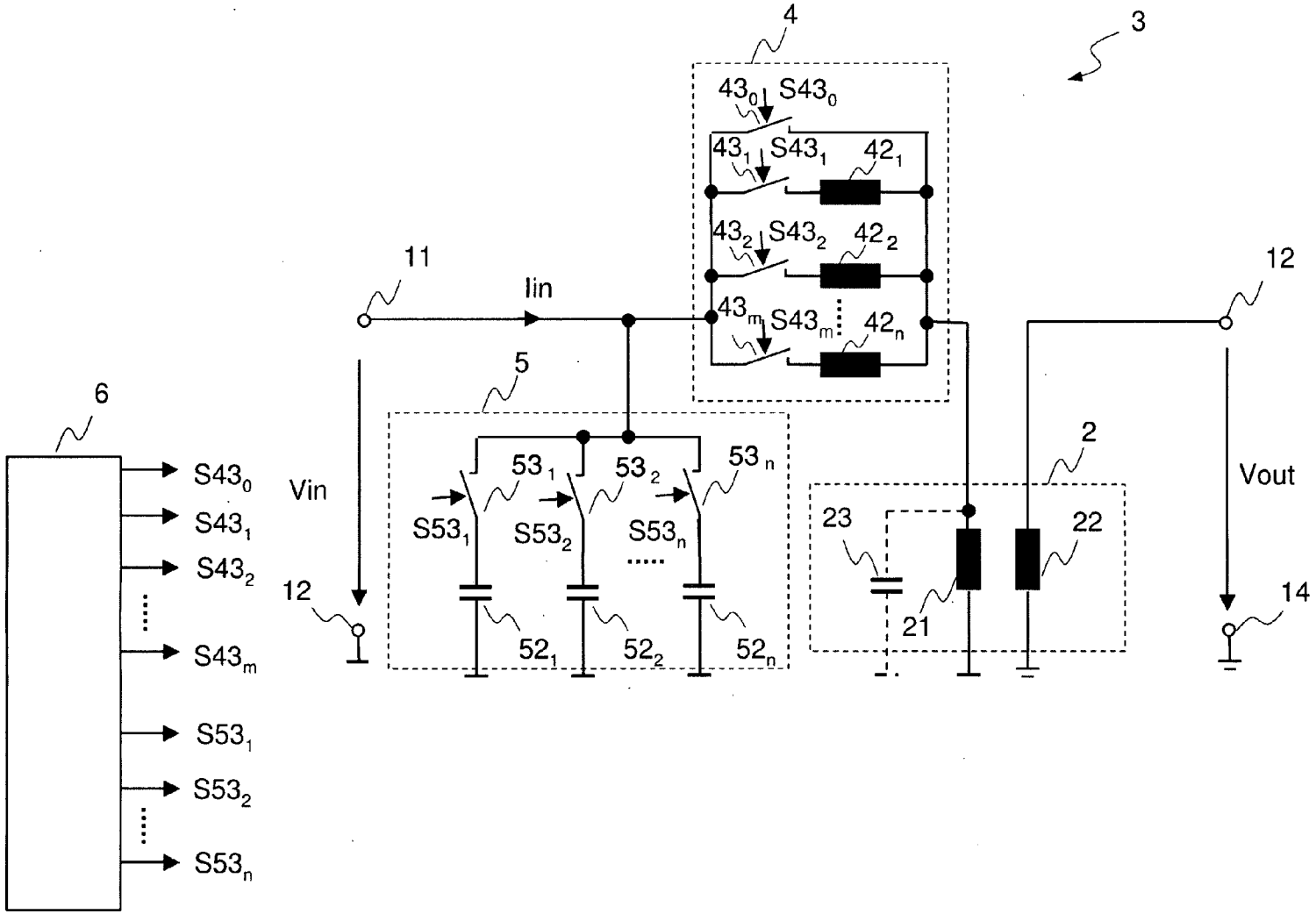
FIG. 6 illustrates a third example of the trimming circuit.

FIG. 6 illustrates an example of a transformer arrangement in which instead of fuses, switches $\mathbf{43}_1$, $\mathbf{43}_2$, $\mathbf{43}_m$ are connected in series to inductances $\mathbf{42}_1$-$\mathbf{42}_n$ of inductance circuit 4. Further, a switch $\mathbf{43}_0$ is connected between input terminal 11 and primary winding 21. Similarly, instead of fuses, switches $\mathbf{53}_1$, $\mathbf{53}_2$, $\mathbf{53}_n$ are connected in series to capacitance $\mathbf{52}_1$, $\mathbf{52}_2$, $\mathbf{52}_n$ of capacitance circuit 5. Each of these switches receives a control signal $S\mathbf{43}_0$-$S\mathbf{43}_m$, $S\mathbf{53}_1$-$S\mathbf{53}_n$. These control signals have one of either an on-level or off-level, an on-level of a control signal switching on the respective switch that receives the control signal, and an off-level of the control signal switches the respective switch off. A control circuit 6 generates these control signals $S\mathbf{43}_0$-$S\mathbf{43}_m$, $S\mathbf{53}_1$-$S\mathbf{53}_n$. The signal levels of control signals $S\mathbf{43}_0$-$S\mathbf{43}_m$ form a set of parameters P4 for adjusting the inductivity of inductance circuit 4, and the signal levels of control signals $S\mathbf{53}_1$-$S\mathbf{53}_n$ form a set of parameters P5 for adjusting the capacity of capacitance circuit 5. The functionality of inductance and capacitance circuits 4, 5 of FIG. 6 correspond to the functionality of inductance and capacitance circuits 4, 5 of FIG. 5 with the difference that the inductivity and the capacity of inductance and capacitance circuit 4, 5 are set electrically using the control signals.

It should be mentioned that for both types of explained inductance and capacitance circuits 4, 5 the different inductances $\mathbf{42}_1$, $\mathbf{42}_2$, $\mathbf{42}_n$ and the different capacities $\mathbf{52}_1$, $\mathbf{52}_2$, $\mathbf{52}_n$ may have the same inductivities and capacities. In this case the overall inductivity of inductance circuit 4 and the overall capacity of capacitance circuit 5 is set by the number of inductances and capacitances that are connected in parallel. In another example the inductances and capacitances have different inductivities and capacities. In this case the overall inductivity of inductance circuit 4 and the overall capacity of capacitance circuit 5 can be set by either activating only one of these inductances/capacitances or by activating two or more inductances/capacitances.

Figure 7:
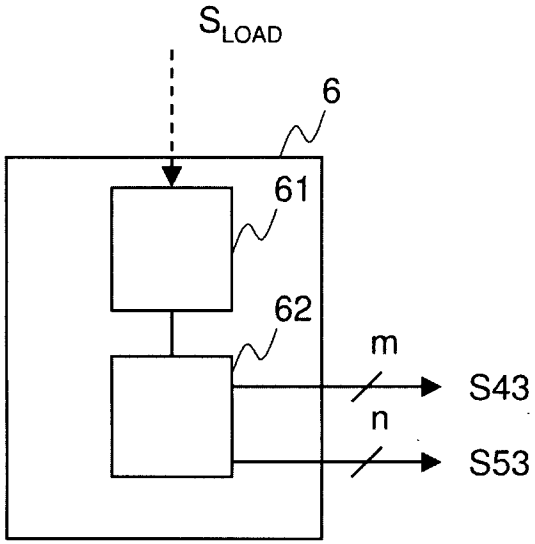
FIG. 7 illustrates a control circuit of the trimming circuit for measuring the load condition and generating trimming signals.

Referring to FIG. 7 control circuit 6 may comprise a programmable circuit 61, like an EPROM, or an EEPROM. Control circuit 6 further comprises a driver circuit 62 that is connected to programmable circuit 61 and that is adapted to read parameters stored in the programmable circuit 61 and to generate the control signals for inductance and capacitance circuits 4, 5 dependent on these parameters. S43, S53 in FIG. 7 denote the group of control signals provided to inductance circuit 4, and the group of control signals provided to capacitance circuit 5.

Programmable circuit 61 can be programmed at the end of the manufacturing process and after MEF/MIF of coreless transformer 2 has been measured. Programmable circuit 61 after programming holds a set of parameters. These parameters determine the overall inductivity/capacity of inductance circuit 4 and capacitance circuit 5 and correspond to the parameters P4, P5 of FIG. 5. These parameters set the overall inductivity/capacity of inductance circuit 4/capacitance circuit 5 such that, considering the measured MEF, MIF of coreless transformer 2, MEF/MIF of the transformer arrangement corresponds to the desired value $MEF_D/MIF_D$.

MEF and MIF of the transformer arrangement, besides MEF and MIF of coreless transformer 2 and the inductivity/capacity of inductance circuit 4 and capacitance circuit 5, depends on the load connected to output terminals 13, 14 during operation of the transformer arrangement. According to one example of a method, several sets of parameters are stored in programmable circuit 61, with each of these different sets of parameters being assigned to one particular load characteristic. Each of these parameter sets considers the measured MEF/MIF of coreless transformer 2 and is adapted to adjust the inductivity/capacity of inductance circuit 4/capacitance circuit 5 such that MEF/MIF of the transformer arrangement corresponds to a given value for a given load characteristic.

Driver circuit 62 selects one of these parameter sets for generating the control signals S43, S53 dependent on a load signal $S_{LOAD}$, this load signal $S_{LOAD}$ including an information of the load characteristic of a load to be connected to output terminals 13, 14. Load signal $S_{LOAD}$ may be generated by any suitable circuit, in particular, by a passive circuit component (not shown) connected to the input terminal of control circuit 6. Using control signal $S_{LOAD}$ a user may adapt transformer arrangement to be used in connection with different loads having different load characteristics.

Figure 8:
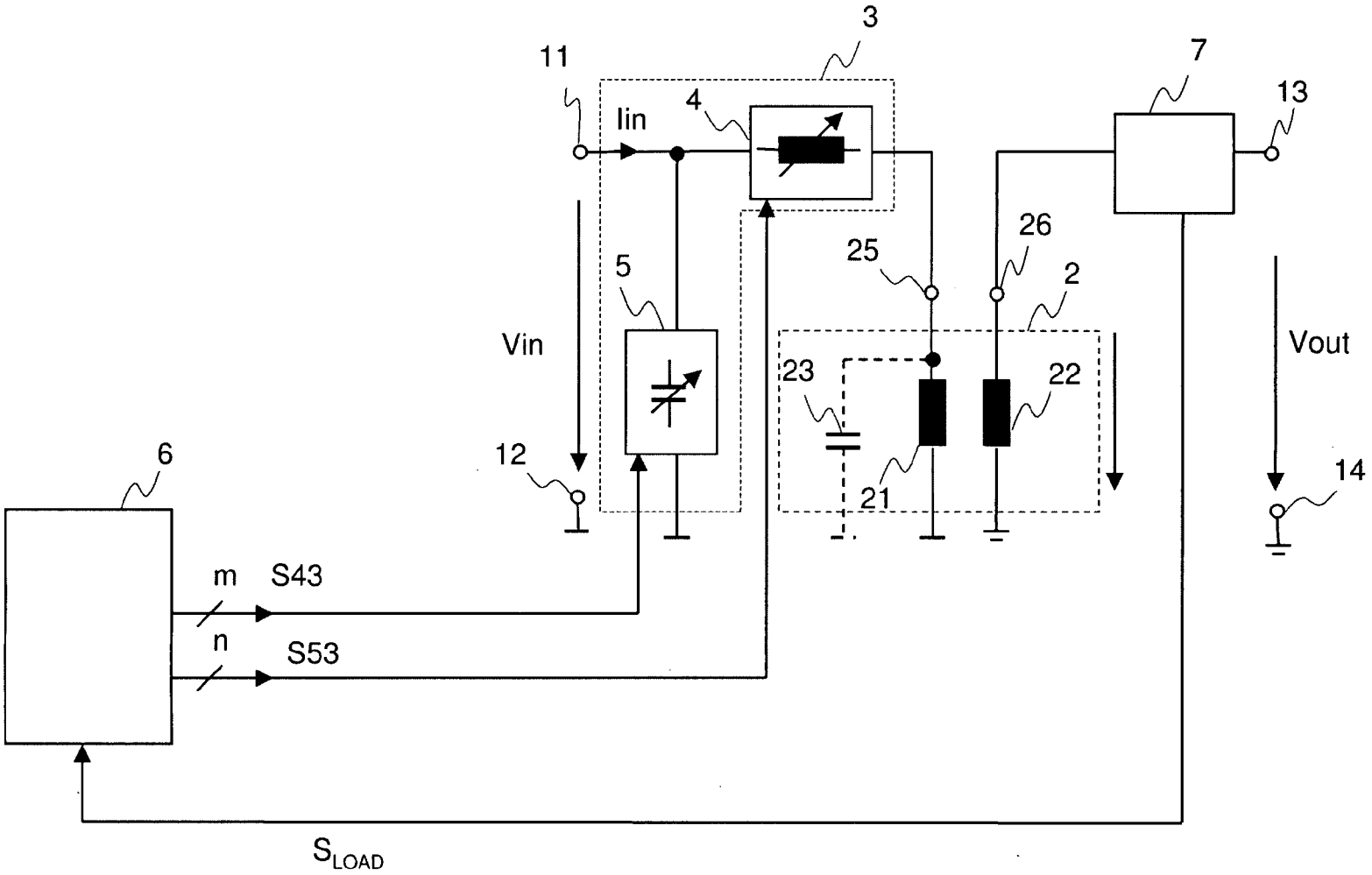
FIG. 8 illustrates a circuit diagram of a transformer arrangement that is capable of being adapted during its operation.

FIG. 8 illustrates another example of a method for trimming the transformer arrangement. In this example load characteristic signal $S_{LOAD}$ is generated during operation of the transformer arrangement. This allows to adapt the transfer characteristic of the transformer arrangement to variations in the load. An evaluation circuit 7 provides load characteristic signal $S_{LOAD}$. Evaluation circuit 7 which is only shown schematically in FIG. 8 is adapted to evaluate the output impedance $Z_{OUT}$ or the output power of the transformer arrangement, and is adapted to generate load characteristic signal $S_{LOAD}$ dependent on these measured output impedance or output power values.

For determining the output power Pout the evaluation circuit 7 measures the output voltage Vout and one of the following: output current Iout, i.e., the current through secondary winding 22; or the input current Iin.

In a method according to a further embodiment, MEF of the transformer arrangement or MIF of the transformer arrangement are measured, a measurement value indicating a current MEF/MIF value is provided to control circuit 6, control circuit 6 being adapted to adjust inductance circuit 4 and capacitance circuit 5 to set MEF/MIF to a given value.

Figure 9:
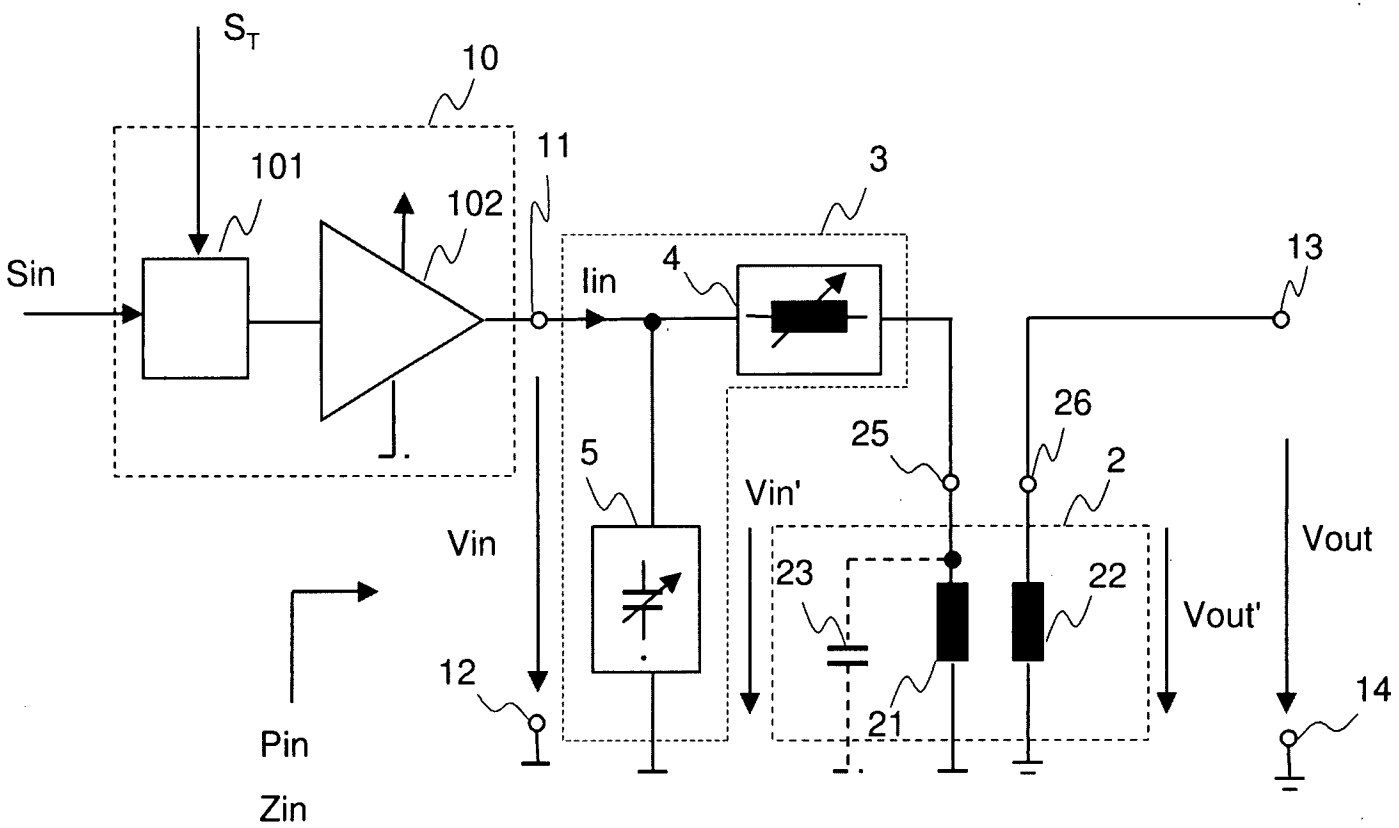
FIG. 9 illustrates a circuit diagram of a transformer arrangement that has an adjustable oscillator.

Referring to FIG. 9 alternatively providing a trimming circuit 3 or additionally providing a trimming circuit 3 the circuit arrangement may comprise a trimmable oscillator circuit 10 that receives a trimming signal $S_T$ for trimming an oscillator frequency to a frequency that corresponds to MEF/MIF of the transformer arrangement. The function of trimming signal $S_T$ corresponds to the function of setting signals P4, P5 that set the characteristic of adjustable inductance and capacitance circuits 4, 5. Trimming signal $S_T$ may therefore be generated in an equivalent manner as these setting parameters. Oscillator circuit 10 further receives an input signal Sin that, for example, serves to activate or deactivate oscillator circuit 10. Input signal Sin may be a pulsewidth-modulated signal that is modulated in accordance with an information signal in order to transmit information via coreless transformer 2.

What is claimed is:

1. A method for signal or power transmission through a circuit arrangement that comprises:
- input terminals;
- output terminals;
- a coreless transformer having a first winding and a second winding;
- a trimming device that is connected to one of the first and second windings and that includes at least one of a variable capacitive component and/or a variable inductive component, the variable capacitive component having an adjustable capacitance and the variable inductive component having an adjustable inductance;
- the circuit arrangement having a maximum efficiency frequency (MEF) and a maximum impedance frequency (MIF) that are dependent on a load connected to the output terminals, and on one of capacitance and inductance;
- the method comprising:
  - applying an input signal that has an input frequency to the input terminals; and
  - adjusting one of the MEF and MIF of the circuit arrangement to differ from the input frequency by less than a given frequency difference by adjusting at least one of the adjustable capacitance and the adjustable inductance.

2. The method according to claim 1, wherein the frequency difference is less than 10% of the input frequency.

3. The method according to claim 1, wherein the frequency difference is less than 5% of the input frequency.

4. The method according to claim 1, wherein the frequency difference is substantially zero.

5. The method according to claim 1, wherein the one of the MEF and MIF of the circuit arrangement is adjusted during operation of the circuit arrangement.

6. The method according to claim 5, further comprising:
- evaluating a parameter selected from the group consisting of: an input power of the circuit arrangement; an input impedance of the circuit arrangement; an output power of the circuit arrangement, and; an output impedance of the circuit arrangement; and
- adjusting the at least one of the adjustable capacity and adjustable inductivity dependent on the evaluated parameter.

7. The method of claim 1, further comprising measuring the MEF or the MIF of the coreless transformer, wherein adjusting the one of the MEF and the MIF is based on the measured MEF or MIF of the coreless transformer.

8. The method of claim 1, further comprising:
- measuring a load impedance coupled to the output terminals; and
- adjusting the at least one of the adjustable capacitance and the adjustable inductance based on the measured load impedance.

9. The method of claim 8, wherein adjusting the at least one of the adjustable capacitance and the adjustable inductance comprises selecting a parameter set of a plurality of parameter sets based on the measured load impedance, wherein each of the plurality of parameter sets represents a corresponds to a setting of the at least one of the adjustable capacitance and the adjustable inductance that corresponds to a particular load impedance.

10. The method of claim 9, wherein selecting a parameter set of a plurality of parameter sets comprises selecting the parameter set of a plurality of parameter sets from a look-up table.

11. The method of claim 9, further comprising generating the plurality of parameter sets after manufacturing the circuit.

12. A circuit comprising:

input terminals;

output terminals;

a coreless transformer having a first winding and a second winding; and a trimming device connected to the first winding, wherein the trimming device comprises a variable capacitive component or a variable inductive component, the variable capacitive component having an adjustable capacitance and the variable inductive component having an adjustable inductance, the circuit has a maximum efficiency frequency (MEF) and a maximum impedance frequency (MIF) that are dependent on a load connected to the output terminals, and on at least one of the variable inductance or the variable capacitance, and the circuit is configured to receive an input signal having an input frequency at the input terminals and to adjust the MEF or the MIF of the circuit to differ from the input frequency by less than a given frequency difference by adjusting at least one of the adjustable capacitance and the adjustable inductance.

13. The circuit of claim 12, further comprising:

a load evaluation circuit coupled to the output terminals, the load evaluation circuit configured to measure a load impedance at the output terminals and provide a load characteristic signal based on the measured load impedance; and a control circuit having an input coupled to an output of the load evaluation circuit and an output coupled to a the trimming device, wherein the control circuit is configured to adjust a capacitance of the adjustable capacitance or adjust an inductance of the adjustable inductance based on the load characteristic signal.

14. The circuit of claim 13, wherein:

the control circuit comprises a memory on which parameter sets are stored; and each of the parameter sets defines a setting for the adjustable capacitance or a setting for the adjustable inductance corresponding to a load condition; and the control circuit is configured to apply one of the settings of a parameter set based on the load characteristic signal.

15. The circuit of claim 14, wherein the control circuit further comprises a driver circuit configured to apply the settings of the parameter set to the trimming device.

* * * * *